US007132910B2

(12) United States Patent
Graczyk et al.

(10) Patent No.: US 7,132,910 B2
(45) Date of Patent: Nov. 7, 2006

(54) WAVEGUIDE ADAPTOR ASSEMBLY AND METHOD

(75) Inventors: Frank J. Graczyk, Mokena, IL (US); Gary Frigo, Frankfort, IL (US); Jeff Paynter, Richton Park, IL (US); Ronald L. Tellas, Schererville, IN (US)

(73) Assignee: Andrew Corporation, Orland Park, IL (US)

( * ) Notice: Subject to any disclaimer, the term of this patent is extended or adjusted under 35 U.S.C. 154(b) by 347 days.

(21) Appl. No.: 10/056,679

(22) Filed: Jan. 24, 2002

(65) Prior Publication Data

US 2003/0137465 A1 Jul. 24, 2003

(51) Int. Cl.
*H01P 1/04* (2006.01)

(52) U.S. Cl. ..... 333/254; 333/255

(58) Field of Classification Search ..... 333/254, 333/255

See application file for complete search history.

(56) References Cited

U.S. PATENT DOCUMENTS

| | | | | |
|---|---|---|---|---|
| 2,774,616 A | | 12/1956 | Dodd et al. | 285/33 |
| 2,880,020 A | | 3/1959 | Audette | 285/255 |
| 2,906,975 A | * | 9/1959 | Donohue et al. | 333/254 |
| 3,221,279 A | | 11/1965 | Gross | 333/98 |
| 3,374,450 A | | 3/1968 | Stewart | 333/98 |
| 3,500,264 A | | 3/1970 | Floyd, Jr. | 333/98 |
| 3,821,670 A | | 6/1974 | Thompson | 333/98 |
| 4,194,380 A | | 3/1980 | Brown et al. | 72/64 |
| 4,491,810 A | | 1/1985 | Saad | 333/126 |
| 4,504,805 A | | 3/1985 | Ekelman, Jr. et al. | 333/126 |
| 4,540,959 A | | 9/1985 | Saad | 333/21 |
| 4,642,585 A | | 2/1987 | Saad | 333/21 |

FOREIGN PATENT DOCUMENTS

| | | |
|---|---|---|
| EP | 0287538 | 10/1988 |

* cited by examiner

*Primary Examiner*—Benny Lee
(74) *Attorney, Agent, or Firm*—Jenkens & Gilchrist

(57) ABSTRACT

A flange adaptor assembly for coupling a waveguide to any number of flange interfaces, wherein the assembly includes a flange adaptor having a predetermined flange coupling interface. The flange adaptor of the present invention is constructed for engaging the common adaptor side of a number of waveguide flanges, while being semi-permanently secured to the end of a waveguide. The flange interface side of the waveguide flanges varies in accordance with the flange interface to which the waveguide is to be connected In this manner, a single waveguide can be manufactured and assembled for use with multiple waveguide flanges.

45 Claims, 11 Drawing Sheets

WAVEGUIDE ADAPTOR ASSEMBLY AND METHOD

BACKGROUND

1. Field of the Invention

The present invention relates generally to waveguides, and more particularly, but not by way of limitation, to a method of and apparatus for coupling a waveguide flange assembly to a waveguide.

2. Description of Related Art

Waveguides are commonly used for transmitting electromagnetic wave energy from one point to another. One of the more extensive commercial uses of waveguides is the transmission of electromagnetic signals from transmitting or receiving equipment. This transmission may occur, for example, between an equipment shelter and an antenna, often mounted on a tall tower. In general, the waveguide consists of a hollow metallic tube of defined cross-section, uniform in extent in the direction of propagation. Within the hollow tube, the electric and magnetic fields are confined, and, since the tubes are normally filled with air, dielectric losses are minimal. Commercially available waveguides may be either of the rigid wall or flexible variety and their cross sectional shapes may be rectangular, circular and elliptical. Such waveguide shapes are, for example, disclosed in U.S. Pat. Nos. 3,822,411 to Merle and 4,047,133 to Merle.

It is generally necessary for waveguides to be coupled to transmitting or receiving equipment at some point. Both the design of the waveguide, as well as coupling systems for use therewith, are critical to the efficiency of the overall system and thus certain design parameters must be applied For example, it is well known to preclude the generation of field variations with height and their attendant unwanted modes. It is similarly well-known to securely mount a waveguide within a waveguide flange connector in order to prevent reflection losses and impendence mismatches. Reliable and secure mountings are not, however, always easy to accomplish. It is for this reason that waveguide flange and coupling assemblies have been designed and implemented for connecting waveguides one to the other as well as to receiving or transmitting equipment, Due to the variety of applications and variations in the design of such transmitting and receiving equipment as well as variations in the designs of waveguides, the waveguide flange and coupling assembly has become an area of intense design focus. Not the least of the reasons for the above referenced focus is the functional efficiency of the waveguide flange and coupling assembly. It is well known that trouble may occur either between the waveguide and its flange or between the two mating flanges of coupled waveguides as well as between a waveguide and equipment being connected thereto. Possible problems which may be encountered include reflected power, high VSWR (voltage standing wave ratio), power leakage and arcing. It is thus critical to provide the appropriate coupling mechanism and methods of assembly for use therewith when linking waveguides to one another or to transmitting or receiving equipment.

Waveguide connectors including flange and coupling assemblies exemplifying prior designs are set forth and disclosed in U.S. Pat. No. 3,374,450 to Stewart (the '450 patent) as well as U.S. Pat. No. 3,500,264 to Floyd (the '264 patent). The '450 patent discloses a waveguide flange and coupling assembly and outlines various aspects of waveguide connection construction. A plurality of clamping elements including a collar and flange member permit waveguide sections to be more easily assembled one to the other and both rigid and flexible waveguides are addressed. Likewise the '264 patent entitled "Connections Means For Waveguide Means" also discloses a method of and apparatus for connecting together sections of waveguides without soldering. U.S. Pat. No. 3,821,670 assigned to Hughes Aircraft Company discloses a "universal type of waveguide flange" aligning and quick release assembly for coupling and decoupling abutting waveguide flanges. The above-referenced functional efficiency and substantially loss free connection aspects are similarly addressed in this reference.

The above-referenced patents address in particular the connection of waveguides one to the other. It is also important to provide an appropriate coupling mechanism with waveguides connected to transmitting and receiving equipment. In that regard, it is typical in the industry to manufacture waveguides, whether rigid or flexible, in standard lengths and shapes. Flanges are generally permanently mounted at one or both ends to allow for attachment to other waveguide sections or telecommunications equipment. Such waveguide flange and coupling assemblies are generally necessary in order to assemble the waveguide sections into a desired array and/or to desired equipment in order to transmit the electromagnetic wave energy between select points. The design of the waveguide flange for the waveguide flange coupling assemblies is thus critical in this aspect.

As stated above, not all transmitting and receiving equipment and not all waveguide sections are manufactured under the same design specifications. It has thus been common to manufacture and stock waveguide sections having different waveguide flange and coupling assemblies permanently affixed on the ends thereof. Certain applications will specify one kind of waveguide flange coupling assembly while another application may specify another. These variations in waveguide couplings can produce both manufacturing and inventorying problems because virtually identical sections of waveguides may be manufactured and then inventoried with different waveguide flange and coupling assemblies on the ends thereof. Some waveguide and flange assemblies will be immediately utilized while others remain in inventory until a particular demand arises. From a commercial efficiency standpoint, this is not a cost-effective approach.

Waveguide and waveguide flange coupling assemblies are critical to the telecommunication industry and necessitate similar production planning and inventory considerations relating to that of other telecommunications equipment. Parts must be kept in stock for particular applications despite the frequency of use. In a competitive economic environment it is, however, incumbent upon manufacturers and suppliers of equipment such as waveguides and waveguides flange adaptors for the telecommunication industry to be able to provide the requisite parts in a relatively short period of time. One approach to reducing inventory capital is to manufacture fewer parts having unique applications. The present invention provides such an approach by utilizing a waveguide flange adaptor capable of multiple applications.

SUMMARY OF THE INVENTION

The present invention is a waveguide adaptor assembly for coupling a waveguide to a radio, antenna, waveguide, or other standard flange interface. The waveguide adaptor assembly includes an adaptor and a flange. The adaptor has a waveguide side adapted to be connected to a waveguide and an opposed flange side having a predetennined flange coupling interface. The flange has a flange interface sided adapted to mate with a particular standard flange interface and an opposed adaptor side configured to mate with said predetermined flange coupling interface on the adaptor.

BRIEF DESCRIPTION OF THE DRAWINGS

A more complete understanding of the method and apparatus of the present invention may be obtained by reference to the following detailed description when taken in conjunction with the accompanying Drawings wherein.

DETAILED DESCRIPTION OF THE INVENTION

Figure 9:
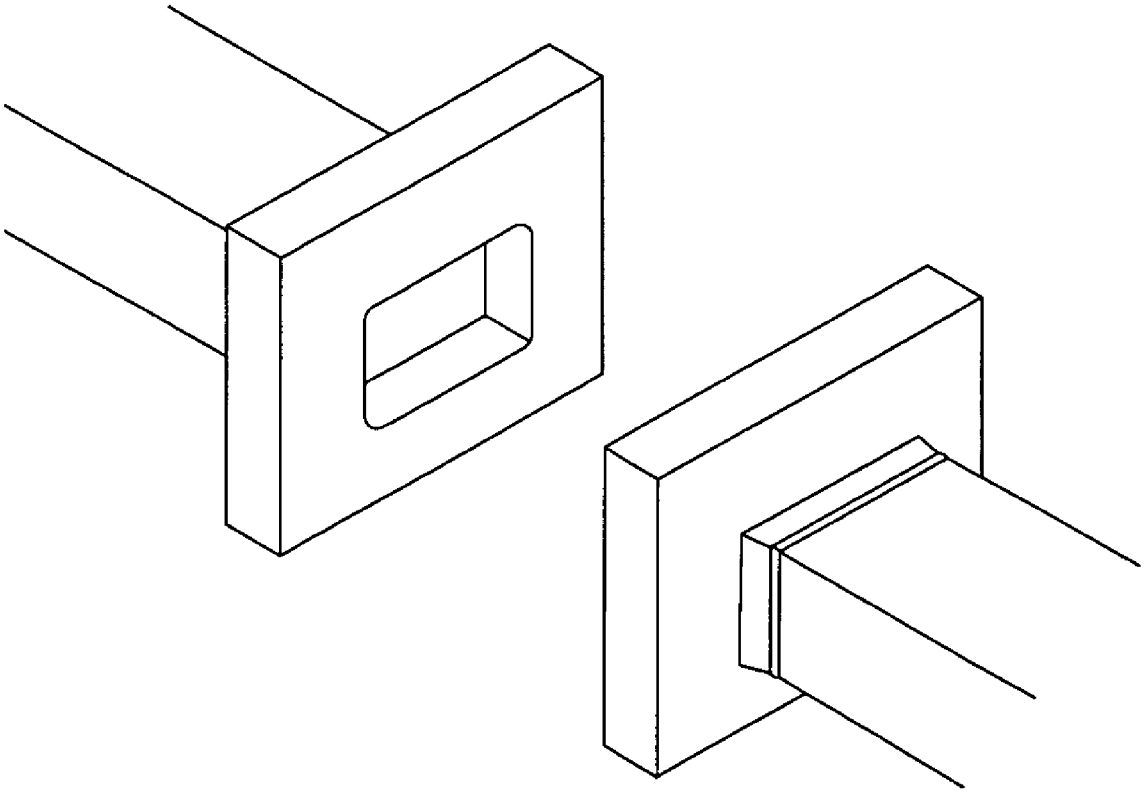
FIG. 9 (PRIOR ART)
FIG. 9 is a perspective view of a waveguide mounting assembly used in the prior art.

It has been found that the use of a waveguide flange adaptor for the mounting of a plurality of waveguide flanges thereto and semi-permanently affixed to at least one end of a waveguide can reduce the required inventory of waveguide assemblies. As referenced above, the use of waveguides is prolific in the telecommunication industry, where specifications for standard flange interfaces, including waveguide mounting flanges, vary from one application to another. There are multiple reasons for such design variations. Flange interface standards vary in different regions of the world, and the designs of one manufacturer may require mating styles and configurations that are different from those of other manufacturers. The waveguides themselves are typically of standard dimensions, while a waveguide flange for coupling a standard waveguide to one transmitter may not be adapted for coupling to a flange interfaces of another manufacturer's equipment. For that reason, waveguide sections must be produced with a variety of mounting flanges, typically permanently secured on the ends thereof. One of the preferred methods of mounting a waveguide to a waveguide flange incorporates the use of molten solder. Although various disadvantages may exist in the use of solder, it is well known that reliable mounting configurations maybe affected with solder for maintaining the integrity of the flange interface with that of the waveguide and reducing inefficiencies associated therewith. Unfortunately, when a particular mounting flange is directly soldered to the end of a waveguide, that particular waveguide and flange assembly may only be used with equipment or other waveguides that have mating flange interfaces. As referenced above, certain waveguide flange interfaces are used less frequently that others, thus requiring more inventory and the concomitant investment of capital. It is an advantage therefore to provide a waveguide and flange adaptor that is designed for multiple applications, whereby the level of inventory for such hardware can be reduced. The present invention provides such a system by providing a waveguide assembled with a flange adaptor on one or both ends thereof. The flange adaptor is designed for interfacing with a plurality of waveguide mounting flanges. In this manner, a single waveguide and flange adaptor can be utilized for a variety of waveguide flanges and related applications, while minimizing the requisite inventory issues. Also, if a customer is using the present invention and attempting to mount a waveguide to a radio, antenna, waveguide, or other standard flange interface, and that customer has ordered the wrong flange type, the supplier can simply rush the customer a number of the correct flange types so that field installation will not have to be deferred Referring to FIG. 9, a prior art waveguide mounting assembly is shown where a flange is soldered to a rectangular waveguide in order to facilitate connection to a radio, antenna, or another waveguide. The flange abuts a flange interface which is affixed to the radio, antenna, or other waveguide. To facilitate connection between the flange and the flange interface, one might use screws, bolts, rivets, solder, etc. The disadvantage of the assembly pictured in FIG. 9, lies in the fact that, as explained above, there are a variety of flange interfaces used in the industry and this assembly does not accommodate such a variety. Thus, in the prior art, users wishing to attach a waveguide to a radio, antenna, waveguide, or other standard flange interface, had to keep an inventory of waveguides soldered to a variety of flanges to ensure that the user had a waveguide compatible to the flange interface of the device to which it sought to attach to the waveguide.

The present invention alleviates such a problem by simply having a waveguide adaptor assembly for connecting a waveguide to a standard flange interface on a radio, antenna or another section of waveguide. Rather than semi-permanently (as by soldering) attaching the waveguide directly to a flange, and then having to inventory all those combinations, the soldering is done on a flange adaptor which can be mated with a variety of flanges that are compatible with any of the various standard flange interfaces for a given waveguide size or cross-sectional geometry. The invention thus drastically reduces the inventorying problem.

Figure 1:
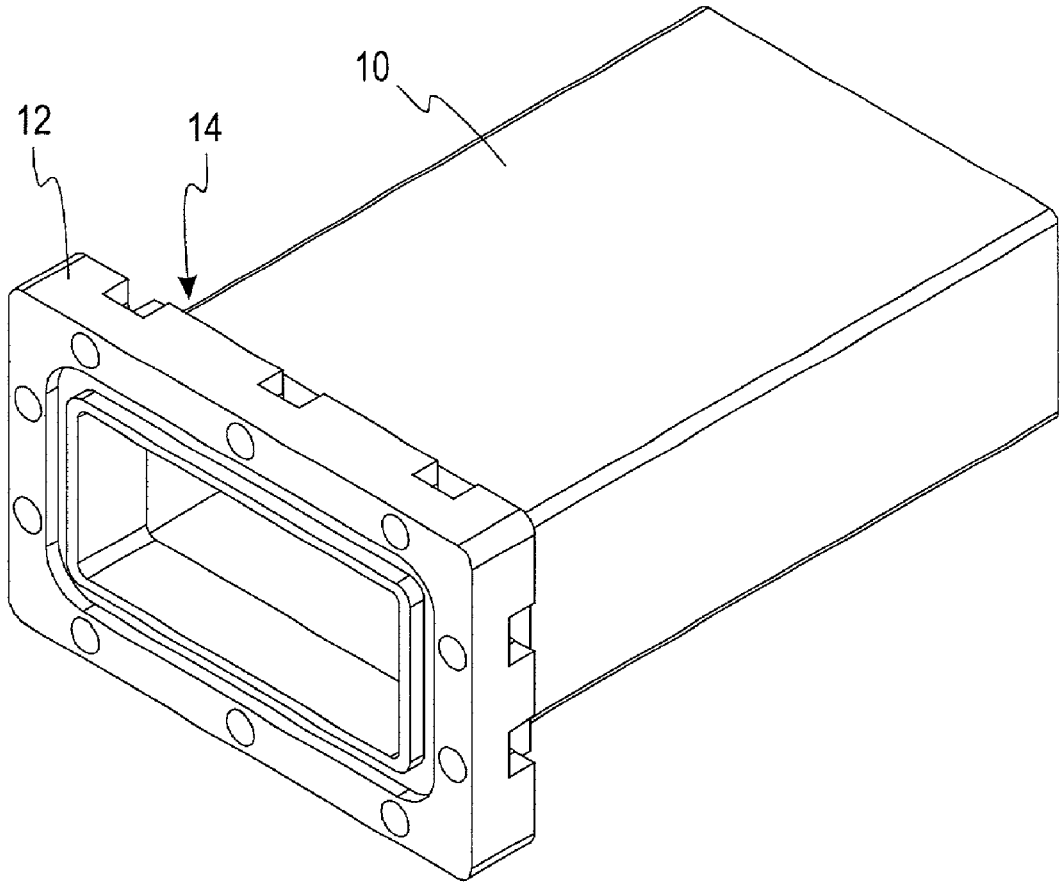
FIG. 1 is a perspective view of one embodiment of a waveguide and flange adaptor assembly constructed in accordance with the principles of the present invention.

Referring first to FIG. 1, there is shown a waveguide 10 to which is mounted to a flange adaptor 12 on a first end 14 of the waveguide into the waveguide side of the flange adaptor 12. Opposite the waveguide side of the flange adaptor 12 is the opposed flange side having a predetermined flange coupling interface for mating against a flange.

It may be seen that the waveguide 10 is of the generally rectangular variety and, in this embodiment, is of rigid construction.

Figure 1A:
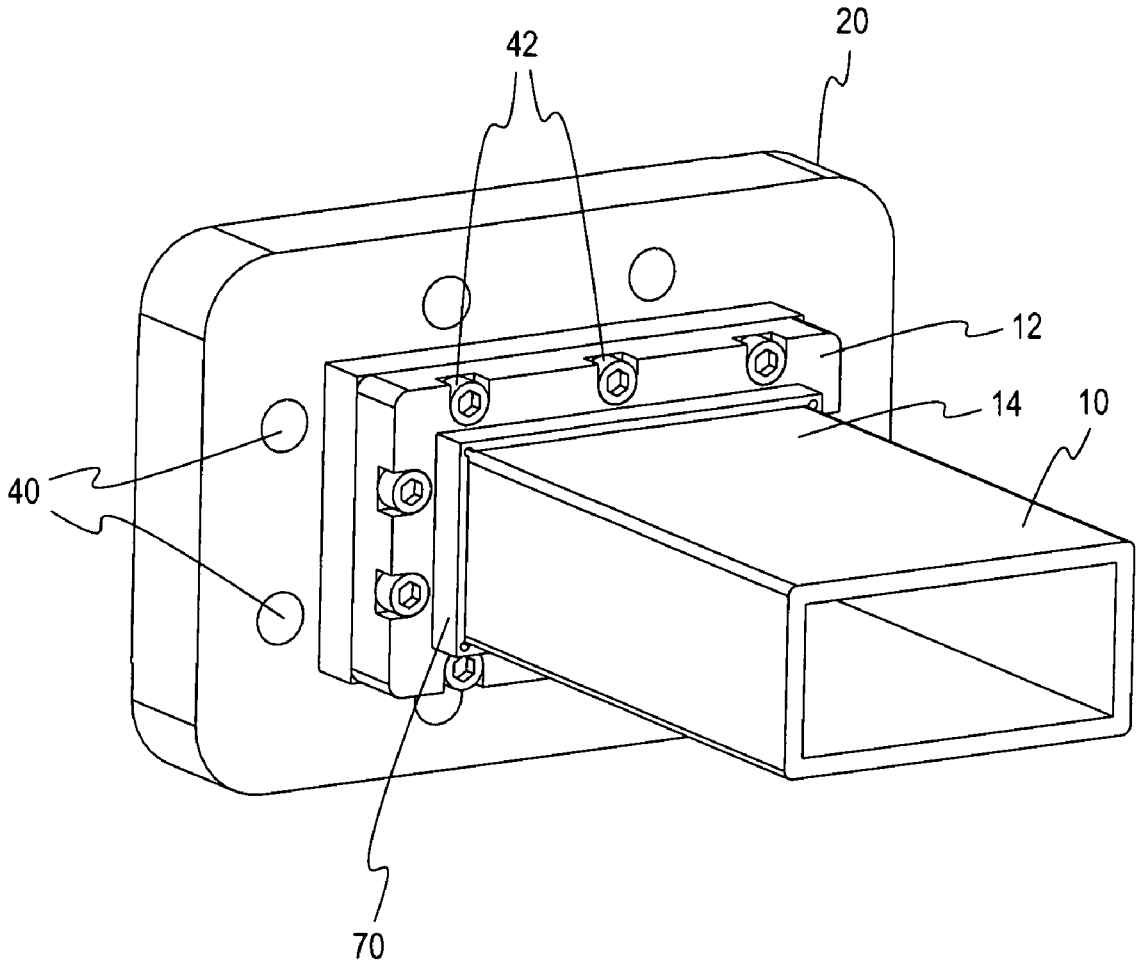
FIG. 1A is a reverse perspective view of one embodiment of the FIG. 1 waveguide and flange adaptor assembly assembled in accordance with the principles present invention.

FIG. 1A illustrates a reverse perspective view of the waveguide-flange adaptor assembly of FIG. 1 connected to a flange 20. In order to secure waveguide 10 to flange adaptor 12, end 14 fits into a waveguide mounting region 70 on the waveguide side of the flange adaptor 12. In order to secure the flange adaptor 12 to the flange 20, threaded screws 42 are screwed into the adaptor side of the flange 20 to secure abutment between the adaptor side of flange 20 and the flange side of the flange adaptor 12. This will be discussed in more detail below. Alternatively, as would be recognized by one skilled in the art, other fastening means may be used in place of threaded screws 42, such as rivets, bolts, welds, solder, etc. Also, in order to facilitate connection to another flange or mounting surface, apertures 40 through flange 20 allow for fastening means such as bolts, screws, rivets, etc. to be placed therethrough. In order to allow the waveguide adaptor assembly of the present invention to be compatible with the variety of flange interfaces used in the industry, the geometry of the flange interface side of flange 20 is varied depending on the geometry of the flange interface (not shown) for which the waveguide adaptor assembly is to be connected. However, to facilitate connection of the flange 20 to the flange adaptor 12, the adaptor side of flange 20 must always be compatible with the flange side of flange adaptor 12.

Figure 2:
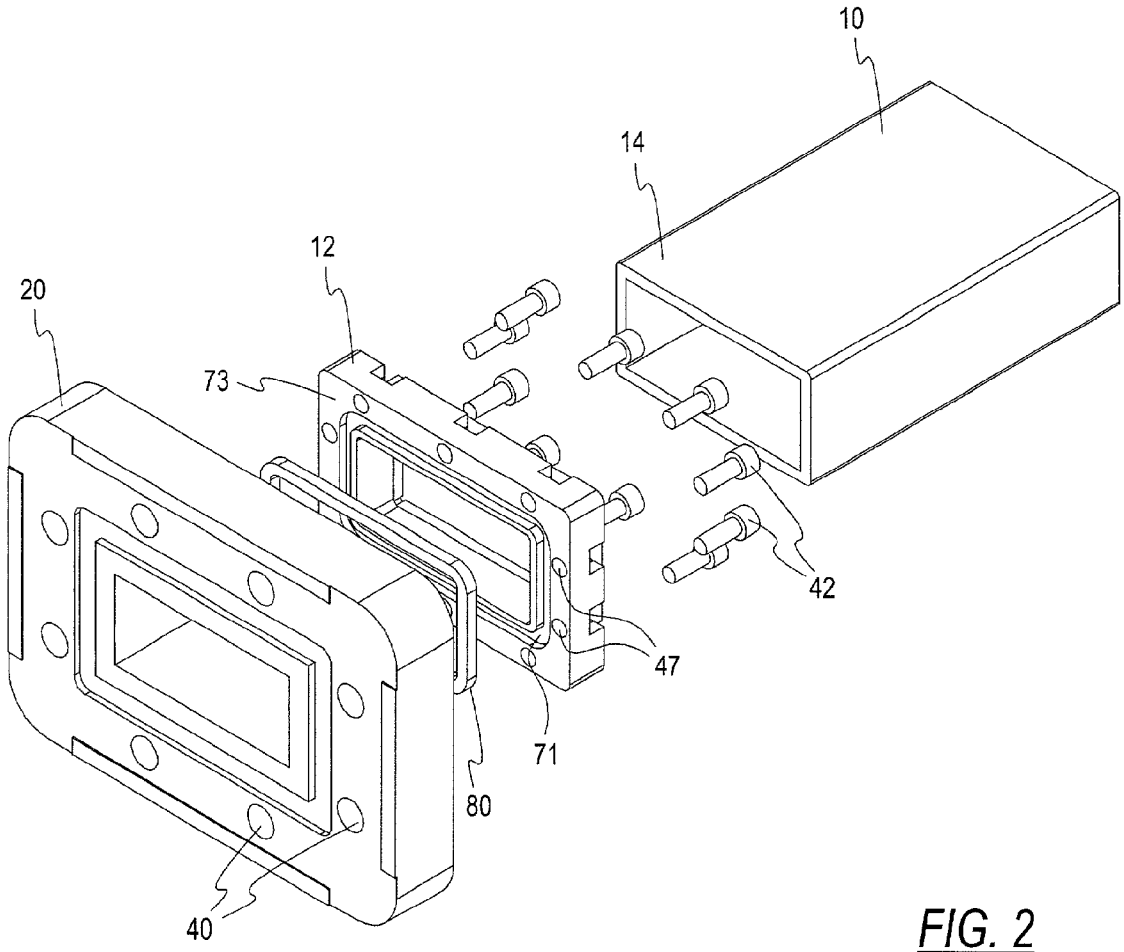
FIG. 2 is an exploded, perspective view of the waveguide and flange adaptor assembly of FIG. 1 and FIG. 1A further illustrating the mounting hardware utilized therewith for coupling waveguide flanges thereto.
Figure 2A:
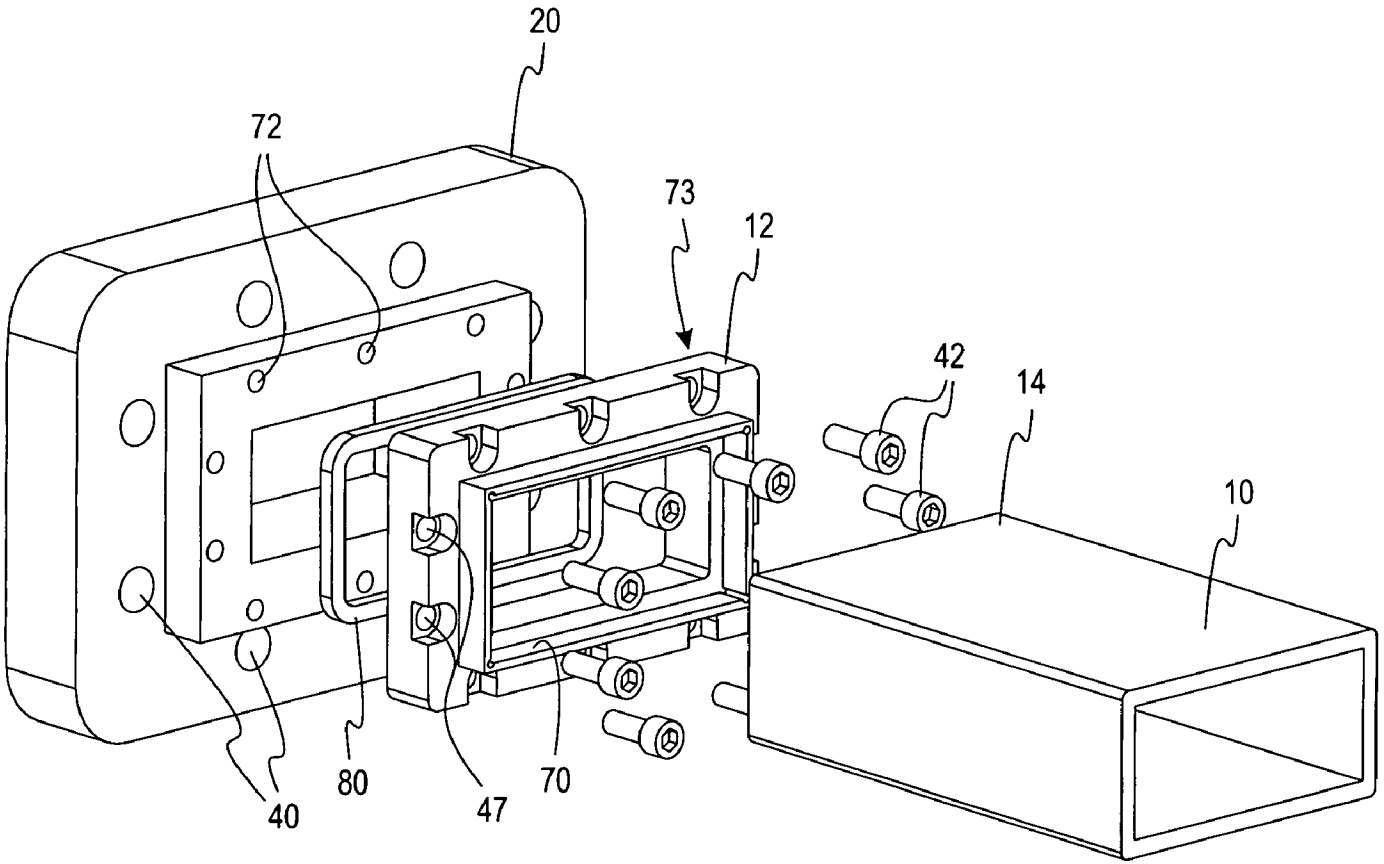
FIG. 2A is a reverse exploded, perspective view of the waveguide and flange adaptor assembly of FIG. 1 and FIG. 1A further illustrating the mounting hardware utilized therewith for coupling waveguide flanges thereto.

Referring now to FIGS. 2 and 2A, the first flange adaptor 12 of first end 14 is shown in an exploded view relative to waveguide 10 for purposes of illustrating the attachment of a waveguide flange thereto. In that regard, a waveguide flange 20 is shown with the appropriate hardware in accordance with the principles of the present invention. The waveguide flange 20 comprises one of a variety of waveguide flanges that may be utilized with the flange adaptor 12. Other waveguide flanges will be described in more detail below, and it should be noted that the particular mounting method and apparatus as set forth in FIG. 2 may likewise be utilized relative to said flanges described in more detail below.

Still referring to FIGS. 2 and 2A, in order to secure the waveguide 10 to the flange adaptor 12, the flange adaptor 12 is adapted for receiving end 14 of waveguide 10 within a waveguide mounting region 70 (see FIG. 2A) of the waveguide side of the flange adaptor 12. To provide for secure engagement, end 14 is typically soldered in place within the waveguide mounting region 70. In order to secure the flange adaptor 12 to the flange 20, apertures 47 (also shown in FIGS. 3 and 3A) are formed through the flange adaptor 12 to allow for receipt of threaded screws 42. When the components of FIGS. 2 and 2A are assembled, the threaded screws 42 go through apertures 47 and into corresponding apertures 72 (see FIG. 2A) of flange 20 to secure the flange interface side of flange 20 to the flange side 73 (also shown in FIGS. 3 and 3A of flange adaptor 12. Apertures 72 of flange 20 are not bored completely through flange 20, but only bored with enough depth to allow threaded screws 42 to securely engage the flange adaptor 12 to the flange interface side of flange 20. In order to accommodate a gasket 80, made of silicone, neoprene, or the like, to facilitate air-tight engagement of the flange 20 and the flange adaptor 12, a groove 71 (see FIG. 2 and FIG. 3) may be formed in the flange side 73 of flange adaptor 12. This is necessary to block the ingress of moisture and because the waveguide assemblies of the present invention may be pressurized.

Referring still to FIGS. 2 and 2A, the waveguide flange 20 is designed for mating with another flange (not shown) or the mating surface of equipment (not shown). As set forth above, secured mounting to such flanges and/or mating surfaces is critically important. For that reason, a plurality of apertures 40 are formed in waveguide flange 20, the apertures 40 being adapted to receive coupling members therethrough. In the event that the apertures 40 of waveguide flange 20 are not threaded, as certain flange apertures will be (e.g. FIGS. 5A AND 6B), securing hardware such as threaded nuts (not shown) would be provided in association with threaded bolts (not shown). Such assembly provides securement of the flange 20 with another flange (not shown) or the mating surface of equipment (not shown).

Still referring to FIGS. 2 and 2A, the bolts (not shown) are preferably pre-installed within the apertures 40 of the waveguide flange 20 when said flange is initially mounted to the flange adaptor 12. The purpose of this initial assembly is to provide the waveguide flange 20 with the necessary hardware for coupling to a mating flange or mating surface. In the event that hardware is known to be available in the mating surface or flange (not shown), the bolts would not necessarily be installed within the apertures 40 of waveguide flange 20.

Figure 3:
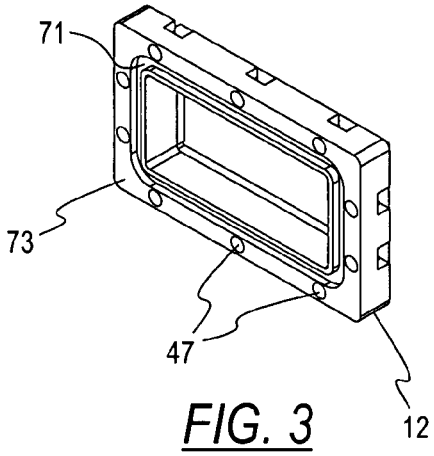
FIGS. 3 and 3A are enlarged perspective views of opposite sides of the flange adaptor of FIGS. 1 and 1A.
Figure 3A:
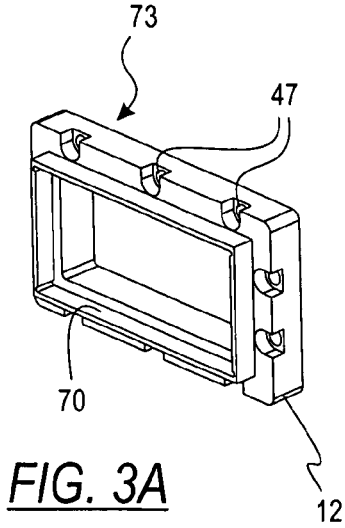

Referring now to FIGS. 3 and 3A, there is shown an enlarged perspective view and a reversed enlarged perspective view, respectively, of the flange adaptor 12 (as seen in FIGS. 1–2) for use with the rigid waveguide 10.

Figure 4:
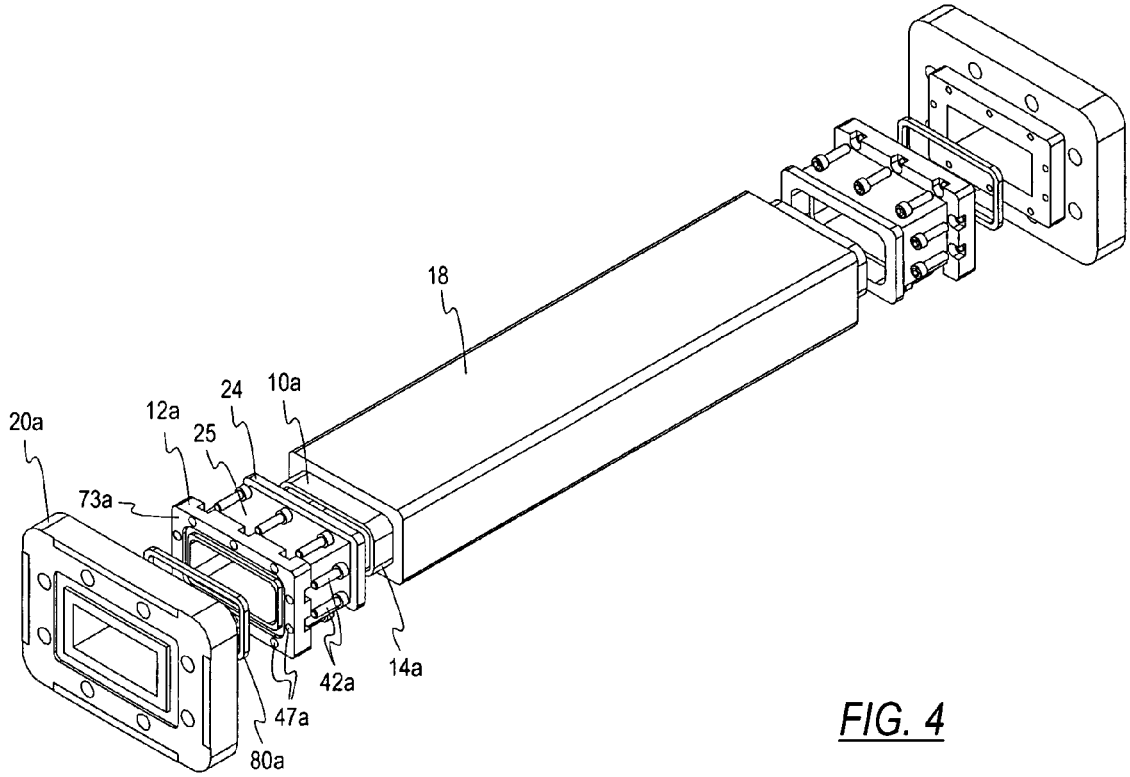
FIG. 4 is an exploded, perspective view of an alternate embodiment of a waveguide and flange adaptor assembly, illustrating the mounting hardware utilized therewith for coupling waveguide flanges thereto.

The present invention may also be used with a flexible waveguide with slight modifications to the flange adaptor. Referring now to FIG. 4, there is an exploded perspective view of the flange/waveguide assembly using a flexible waveguide 10A. A jacket 18 is typically provided around the waveguide 10A, however, in order to allow assembly to the flange adaptor 12A, the jacket 18 leaves the front end 14A of the waveguide 10A bare. To provide stabilization of the jacket 18 when waveguide 10A is mounted to flange adaptor 12A, a rear flange 24 (also shown in FIGS. 5, 5A) is provide on flange adaptor 12A which adheres to the jacket 18. The adhesion of the jacket 18 to the waveguide 10 and flange adaptor 12 is preferably facilitated by the application of heat. The jacket 18 may be made of neoprene or the like, which will bond to metal surfaces when heated. In order to allow the threaded screws 42A of the present embodiment to be placed into the apertures 47A of the flange adaptor 12A, the flange adaptor 12A has an elongated region 25. This allows the threaded screws 42A of the present embodiment to be placed into the apertures 47A without impediment from the rear flange 24. The geometries and functions of the front end 73A (also shown in FIGS. 5, 5A) of the flange adaptor 12A, the gasket 80A, and the flange 20A are identical to those describe in relation to the rigid waveguide assembly in FIGS. 1–2, and will not be repeated herein.

Figure 5:
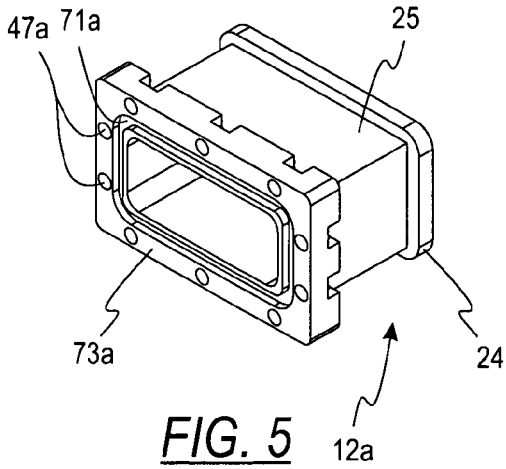
FIGS. 5 and 5A are enlarged, perspective views of opposite sides of the flange adaptor of FIG. 4.
Figure 5A:
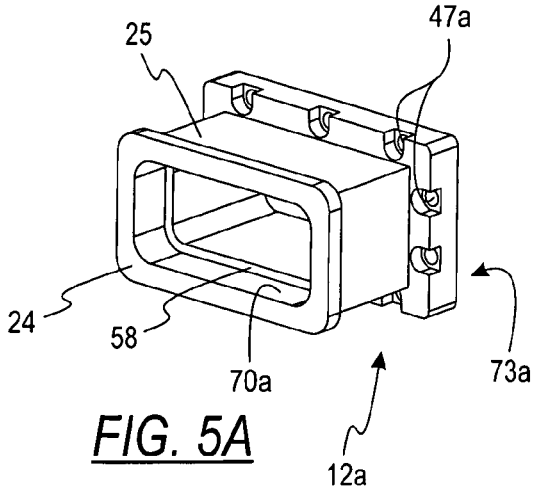

Referring now to FIGS. 5 and 5A, there is shown an enlarged perspective view and a reversed enlarged perspective view, respectively, of the flange adaptor 12A (as seen in FIG. 4) for use with the flexible waveguide 10A. To accommodate a generally rectangular waveguide, the flange adaptor 12A of this particular embodiment has a generally rectangular passageway formed therethrough. As will be seen below, waveguide mounting flanges having variations in shape and size will be specifically set forth and shown. Other shapes and sizes are considered to be within the spirit and scope of the present invention.

In order to provide an area where the bare end 14A of the waveguide 10A can fit into the flange adaptor 12A, the flange adaptor 12A is provided with a waveguide mounting region 70A (also shown in FIG. 5A) comprising a shoulder 58 to abut the end 14A of the waveguide 10A (seen in FIG. 4). To securely fasten the waveguide 10A to the flange adaptor 12A, the waveguide 10A of the present embodiment is typically soldered to the flange adaptor 12A when end 14A is properly disposed in waveguide mounting region 70A abutting shoulder 58.

Still referring to FIGS. 5 and 5A, the flange adaptor 12A is preferably formed of stainless steel, or the like, and may be milled from bar stock or initially cast and milled therefrom. Such manufacturing techniques are well known in the industry. Likewise, it is well known to connect a waveguide 10A of the type shown in FIG. 4 to waveguide flanges with the use of solder or the like. It is for this reason that the shoulder 58 (see FIG. 5A) is of sufficient length for receiving the requisite portion of the waveguide 10A as shown in FIG. 4 for the application of solder thereto. In order for the jacket 18 to have sufficient bonding area, the rear flange 24 must be of sufficient height. Similarly, as stated above, in order to facilitate the joining of the flange adaptor 12A to the flange 20A, the elongated region 25 must be of sufficient length. As with the flange adaptor for the rigid waveguide assembly in FIG. 2 and 2A, the flange adaptor 12A of the present embodiment has apertures 47A to facilitate threaded screws or another type securing mechanism, and a groove 71A (see FIG.5) to allow for a gasket to allow air-tight joining to a flange.

Figure 6A:
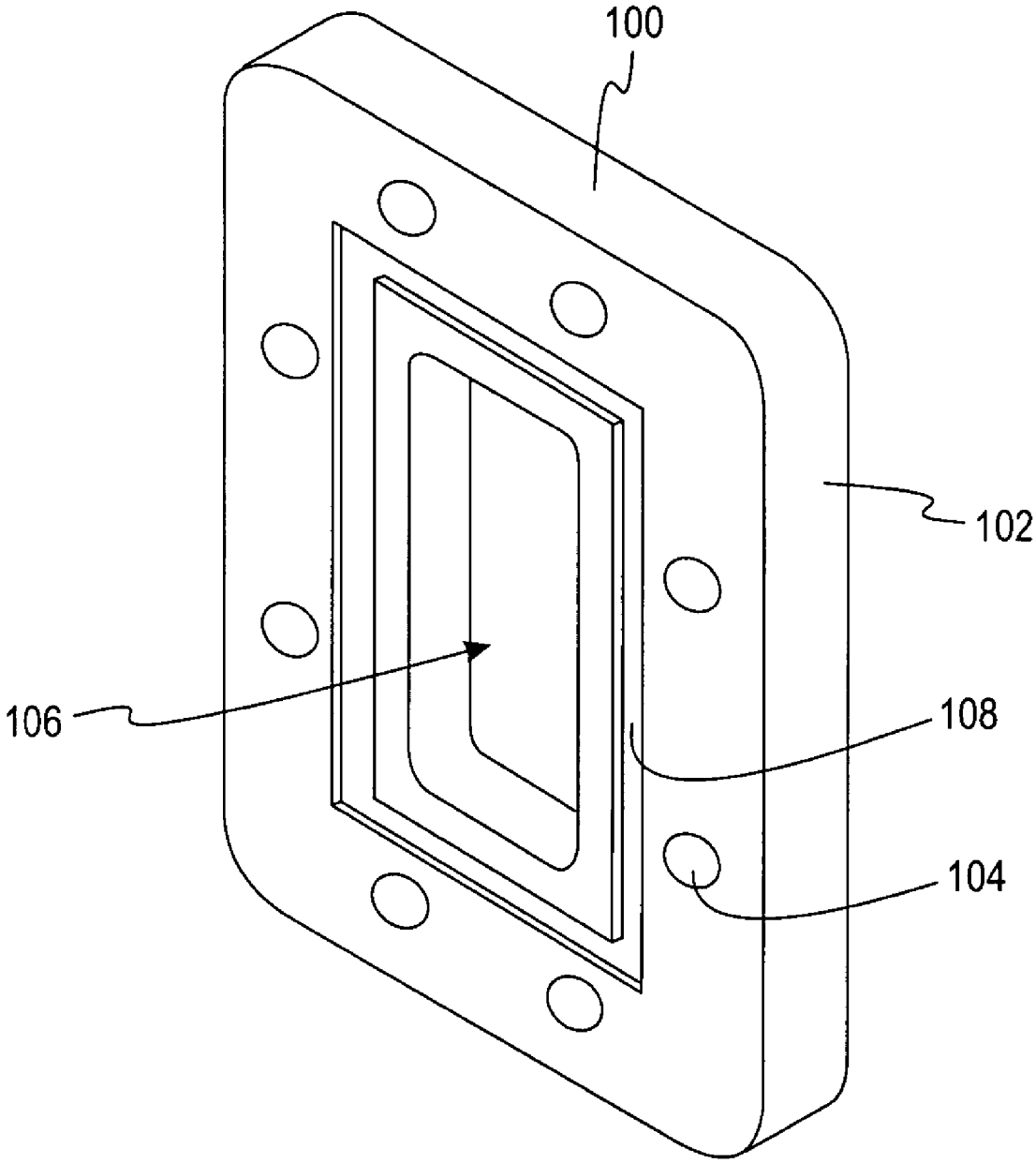
FIGS. 6A and 6B are perspective views of opposite sides of another waveguide flange adapted for mounting to the flange adaptors of FIGS. 3—3A and FIGS. 5—5A and illustrating one aspect of the a mounting configuration thereof.
Figure 6B:
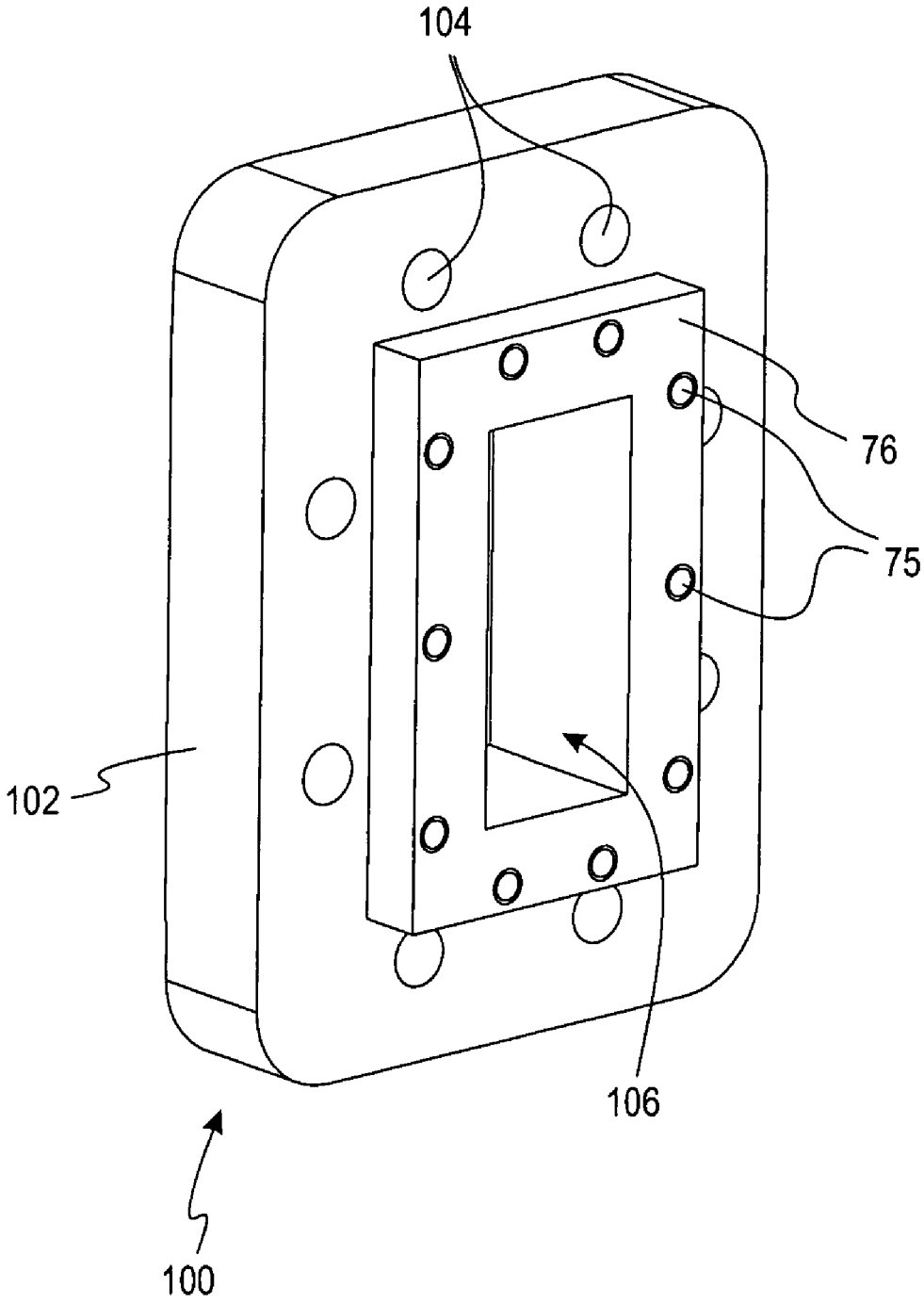

There are a number of standard mating flanges presently in the field. The present invention allows the waveguide/flange adaptor assemblies of FIGS. 2,2A and 4 to be connected to any of these standard mating flanges just by altering the geometry of flange 20 and 20A seen in FIGS. 2, 2A and 4. In order for these alternative flanges to be compatible with the flange adaptor, a rear portion of the flange should be raised (as with flange interface side of flange 20 in FIG. 2A) and have partially drilled apertures therethrough (as with apertures 72 in flange interface side of flange 20 in FIG. 2A) that line up with apertures 47 and 47A of the flange adaptors 12 and 12A (FIGS. 3, 3A and 5, 5A), regardless of the geometry of the flange used to ensure compatibility in the field. FIGS. 6A, 6B; 7A, 7B, 7C, 7D; 8A, 8B, 8C, 8D illustrate a variety of geometries of flanges that may be used with the present invention to enable compatibility with other mating surfaces in the field. It should be understood that the rear faces of each of these flanges have raised rear portions 76 (seen in FIG. 6B) with partially drilled apertures 75 (seen in FIG. 6B) that line up with apertures 47 and 47A of the flange adaptors 12 and 12A.

Referring now to FIG. 6A, there is shown a perspective view of a alternate waveguide flange 100 which may be utilized in conjunction with the flange adaptors 12 and 12A of the present invention (see FIGS. 3, 3A and 5, 5A). Waveguide flange 100 is formed of a generally rectangular body which includes a plurality of holes 104 (also shown in FIG. 6B) formed therethrough and adapted for coupling to a mating surface. A generally rectangular passage 106 (also shown in FIG. 6B) is formed centrally through the waveguide body 102 (also shown in FIG. 6B) and is further circumscribed by a recess 108 formed therearound. The recess 108 is preferably formed for the receipt of a gasket to be utilized in the mounting of waveguide flange 100 to a mating surface.

Referring now to FIG. 6B, there is shown a perspective view of the rear surface of the waveguide flange 100 illustrating certain aspects of the construction thereof. As stated above, in order to accommodate mounting to the flange adaptors 12 and 12A of FIGS. 3, 3A and 5, 5A, a raised rear portion 76 is provided with threaded holes 75 partially drilled therethrough for securely receiving threaded screws 42 seen in FIGS. 2,2A and 4. The spacing of plurality of holes 104 is selected relative to the hole patterns of the mating surface.

Figure 7A:
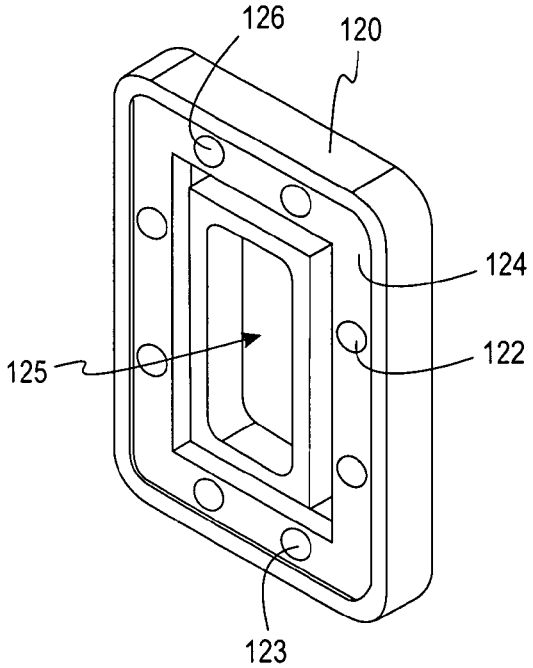
FIGS. 7A, 7B, 7C, and 7D are enlarged perspective views of additional waveguide flanges adapted for mounting to the flange adaptors of FIGS. 3, 3A and FIGS. 5, 5A.

Referring now to FIGS. 7A through 7D, there are shown four different rectangular waveguide flange designs. In FIG. 7A, a rectangular waveguide flange 120 is formed with apertures 122 comprising a hole pattern 123. The face 124 of waveguide flange 120 includes a recess 126 which is formed around a central passageway 125. The recess 126 may be seen to be found at a greater depth than that shown in FIG. 6A for recess 108. This is yet another example of variations to waveguide flange designs.

Figure 7B:
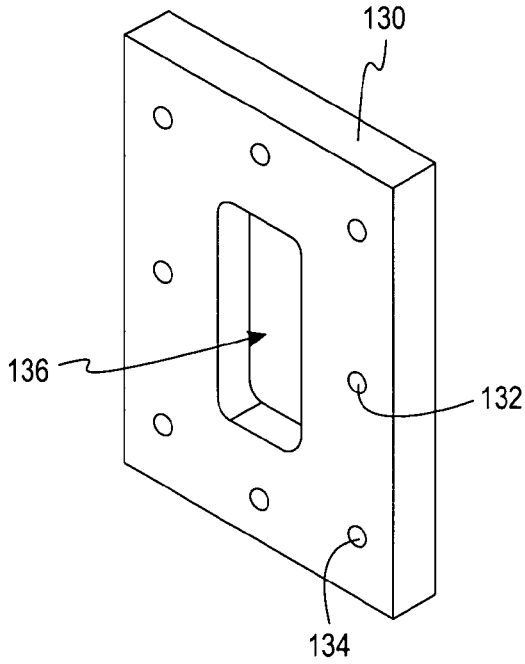

Referring now to FIG. 7B, there is shown a rectangular waveguide flange 130 having a plurality of apertures 132 in a hole pattern 134 that is distinctly dissimilar to the hole pattern 123 of flange 120 of FIG. 7A. The waveguide flange 130 includes a generally rectangular central passage 136 that is adapted for mating engagement with the flange adaptors 12 and 12A of FIGS. 3,3A and 5,5A as described above. The variation in the hole pattern 134 of waveguide flange 130 illustrates the fact that the waveguide flange 130 is adapted for receiving a variety of hole patterns for the securement of mating surfaces thereon.

Figure 7C:
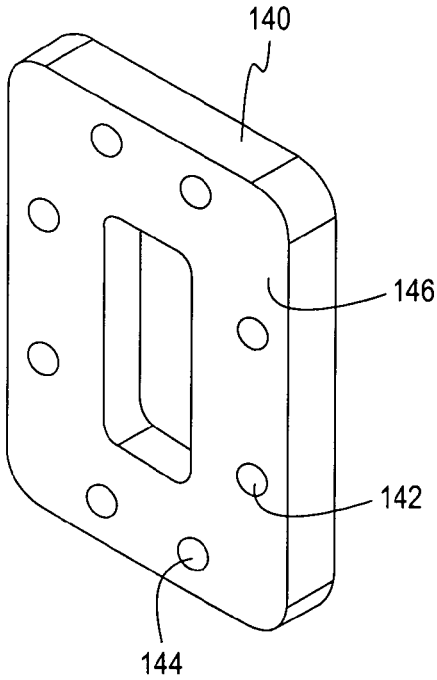

Referring now to FIG. 7C, a waveguide flange 140 is set forth and shown in yet a different configuration relative to the waveguide flanges of FIGS. 7A and 7B. Although waveguide flange 140 has a plurality of apertures 142 forming a pattern 144 which appears similar to the pattern 123 of apertures 122 in waveguide flange 120 of FIG. 7A, the face 146 of waveguide flange 140 is planar. It is not formed with a gasket recess, as was the case with waveguide flange 130 of FIG. 7B.

Figure 7D:
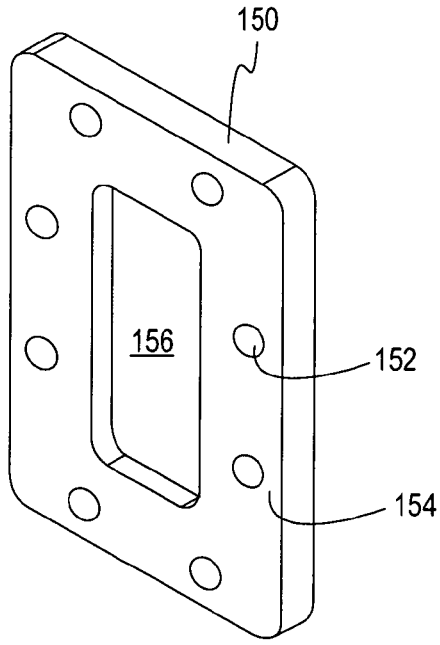

Referring now to FIG. 7D, there is shown a waveguide flange 150 having a plurality of holes 152 in a pattern 154. A central passageway 156 is found therethrough. It may be seen that the thickness of waveguide flange 150 is less than that shown for the waveguide flanges in FIGS. 7A–7C.

Figure 8A:
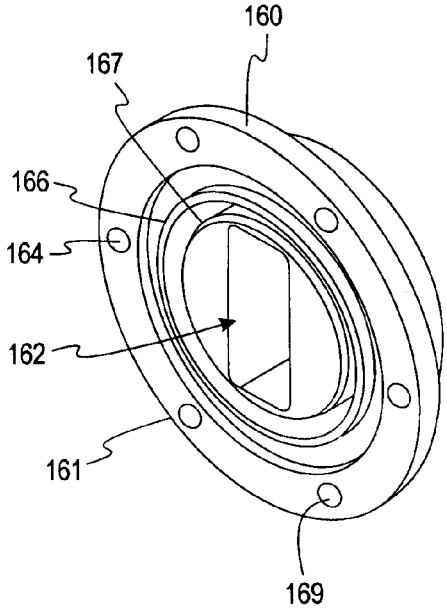
FIGS. 8A, 8B, 8C, and 8D are enlarged perspective views of additional waveguide flanges adapted for mounting to the flange adaptors of FIGS. 3, 3A and FIGS. 5, 5A.
Figure 8B:
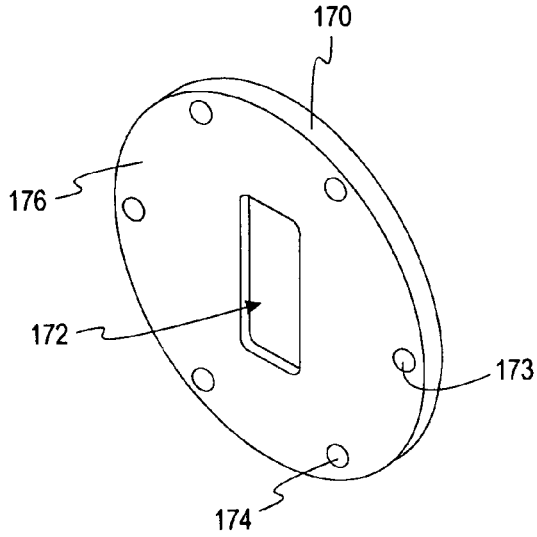

Referring now to FIG. 8A there is shown a waveguide flange 160 having a distinctly dissimilar shape to that of the waveguide flanges of FIGS. 6A and 6B, and 7A through 7D. Waveguide flange 160 presents a circular, or round shape with a rectangular passage 162 formed therethrough. The face 164 of round waveguide flange 160 is likewise constructed with round recesses 166 and 167 formed within face 164 thereof The plurality of apertures 169 are formed therein in an aperture array 161. It may be seen that aperture array 161 is circular in shape and will thus require rear face (not shown) having a shape and size accommodating mounting to the flange adaptors 12 and 12A Referring now to FIG. 8B, there is shown yet another round waveguide flange 170 having a generally rectangular passage 172 formed therein. The plurality of apertures 173 are formed in a hole pattern 174. The face 176 of round waveguide flange 170 is substantially planar in construction.

Figure 8C:
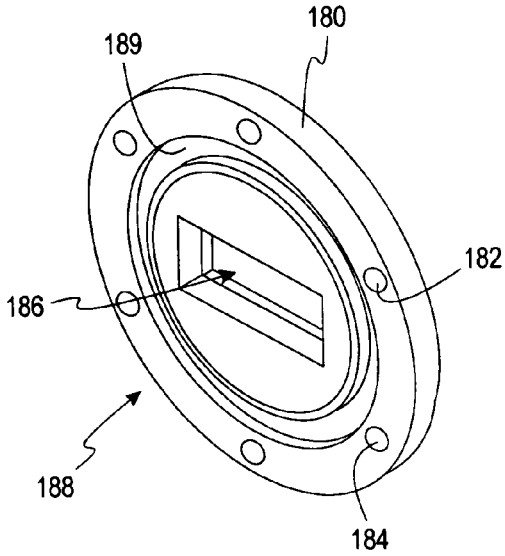

Referring now to FIG. 8C, there is shown yet another waveguide flange 180 having a plurality of apertures 182 formed in a hole pattern 184 therearound. A generally rectangular passage 186 is formed in the face 188 of the generally round waveguide flange 180. A recess 189 is formed in the face 188 and provides a surface for the seating of a gasket therein.

Figure 8D:
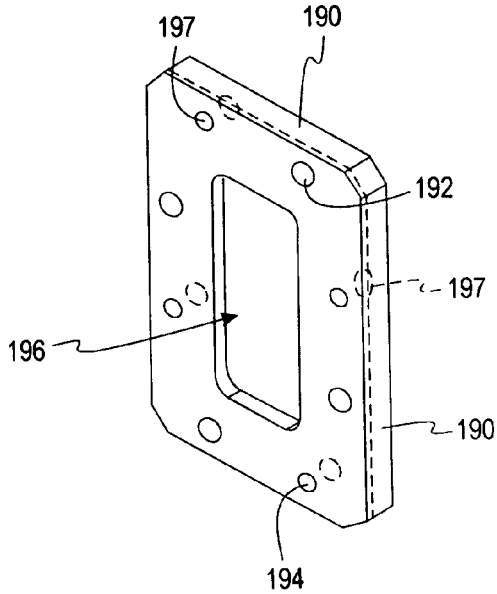

Referring now to FIG. 8D, a generally rectangular waveguide flange 190 is shown formed with a plurality of apertures 192 formed therein in an array 194. A generally rectangular passageway 196 is likewise formed therethrough. A plurality of the apertures 192 are threaded. For example, holes 197 include dotted lines found across the rear surface 198 of waveguide flange 190. As referenced above, some mating surfaces are designed with alternating threaded and clearance holes.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

The invention claimed is:

1. A system comprising:

a library of flanges adapted for different standard flange interfaces; and a waveguide adaptor assembly for coupling a waveguide to a radio, antenna, waveguide or other standard flange interface, comprising:

an adaptor having a waveguide side adapted to be connected to a waveguide and an opposed flange side having a predetermined flange coupling interface, and a flange selected from said library of flanges a said selected flange having a flange interface side adapted to mate with a particular standard flange interface, and an opposed adaptor side configured to mate with said predetermined flange coupling interface on said adaptor;

wherein said predetermined flange coupling interface of said adaptor is configured to mate with any of said opposed adaptor side of any flange in said library of flanges.

2. The waveguide adaptor assembly of claim 1 wherein said each flanges in said library of flanges have on said adaptor side thereof a common provision configured to mate with said predetermined flange coupling interface of said adaptor.

3. The waveguide adaptor assembly of claim 2 wherein said provision includes a raised portion.

4. The waveguide adaptor assembly of claim 1 wherein said adaptor is soldered to said waveguide.

5. The waveguide adaptor assembly of claim 1 wherein said adaptor is fastener-connected to said selected flange and soldered to said waveguide.

6. The waveguide adaptor assembly of claim 1 wherein said adaptor has on said flange side a central opening surrounded by a recess adapted to receive a gasket.

7. The waveguide adaptor assembly of claim 1 wherein said adaptor is fastener-connected to said selected flange.

8. A waveguide adaptor useful for coupling a waveguide to a radio, antenna, waveguide or other standard flange interface, said adaptor having a waveguide side adapted to be connected to a waveguide and an opposed flange side having a predetermined flange coupling interface adapted to be connected to a flange selected from a library of flanges adapted for different standard flange interfaces; wherein said flange coupling interface is configured to mate with any of said different standard flange interfaces, wherein said adaptor is soldered to said waveguide.

9. The waveguide adaptor of claim 8 wherein said adaptor has on said flange side a central opening surrounded by a recess adapted to receive a gasket.

10. The waveguide adaptor of claim 8 wherein said adaptor is adapted to be fastener-connected to the selected flange.

11. The waveguide adaptor of claim 8 wherein said adaptor is adapted to be fastener connected to said selected flange.

12. For use in a waveguide adaptor assembly for coupling a waveguide to a radio, antenna, waveguide or other standard flange interface, a library of flanges, each having a flange interface side adapted to mate with a different one of said standard flange interface, and an opposed side configured to mate with an adaptor connected to a waveguide; wherein each of said flanges in said library of flanges has on said opposed side a provision common to all flanges in said library which is configured to mate with said adaptor.

13. The library of flanges of claim 12 wherein said provision includes a raised portion.

14. A combination comprising:

a library of flanges adapted for different standard flange interfaces;

a radio, antenna, waveguide or other structure having a standard flange interface; and a waveguide adaptor assembly for coupling a waveguide to said standard flange interface, comprising:

an adaptor having a waveguide side adapted to be connected to a waveguide and an opposed flange side having a predetermined flange coupling interface; and a flange selected from said library of flanges adapted for different standard flange interfaces, said selected flange having a flange interface side adapted to mate with a particular standard flange interface, and an opposed adaptor side configured to mate with said predetermined flange coupling interface on said adaptor;

wherein said predetermined flange coupling interface of said adaptor is configured to mate with said opposed adaptor side of any flange in said library of flanges.

15. The combination of claim 14 wherein said adaptor is fastener-connected to said flange and soldered to said waveguide.

16. The combination of claim 14 wherein said adaptor has on said flange side a central opening surrounded by a recess adapted to receive a gasket.

17. The combination of claim 14 wherein said flanges in said library of flanges have on said adaptor side thereof a common provision configured to mate with said predetermined flange coupling interface of said adaptor.

18. The combination of claim 17 wherein said provision includes a raised portion.

19. The combination of claim 14 wherein said adaptor is fastener-connected to said flange.

20. The combination of claim 14 wherein said adaptor is soldered to said waveguide.

21. A method for coupling a selected one of a plurality of waveguide flanges to a waveguide, said method comprising the steps of:

providing said plurality of waveguide flanges, each of said plurality of waveguide flanges having a generally common internal mating configuration;

forming a flange adaptor having inner and outer surfaces and wherein said outer surface is adapted to engage said generally common internal mating configuration of said waveguide flanges and said inner surface is adapted for secured mounting to a said waveguide; and clamping said selected one of a plurality of waveguide flanges to said outer surface of said flange adaptor such that said waveguide and said flange adaptor mounted thereto may be coupled to said select ones of said waveguide flanges for use therewith.

22. The method as set forth in claim 21, wherein said waveguide is generally rectangular in cross sectional configuration and said step of forming said flange adaptor includes forming said inner surface in a generally rectangular configuration.

23. The method as set forth in claim 22 and further including the step of providing said one of a plurality of waveguide flanges in a generally rectangular configuration adapted for mounting to said generally rectangular waveguide and the step of forming said at least one flange adaptor with a generally rectangular passageway therethrough and axially aligning said passageway with said generally rectangular waveguide for the securement thereto.

24. The method as set forth in claim 23, wherein said securement of said axially aligned passageway to said generally rectangular waveguide includes the step of flowing molten solder therebetween.

25. The method as set forth in claim 24, and further including the step of forming said at least one flange adaptor with at least one aperture therethrough whereby at least one threaded plate fastener can be extended through said at least one aperture into said one of a plurality of waveguide flanges.

26. A system comprising:

a waveguide;

a plurality of waveguide flanges, wherein said waveguide flanges have a generally common internal mating configuration;

at least one flange adaptor having inner and outer surfaces and wherein said outer surface is adapted to engage said generally common internal mating configuration of each one of said plurality of waveguide flanges and said inner surface is adapted for secured mounting to said waveguide;

at least one clamping member adapted for fastening to select ones of said waveguide flanges; and at least one fastener for securing said at least one flange adaptor between said at least one clamping member and said select ones of said waveguide flanges such that said waveguide and said at least one flange adaptor mounted thereto may be coupled to said waveguide flanges for use therewith;

wherein said inner surface of said at least one flange adaptor comprises a waveguide mounting region adapted for receiving an end of said waveguide therein for the secured mounting thereto, said waveguide is generally rectangular in cross sectional configuration and wherein said at least one flange adaptor is constructed with a generally rectangular passageway disposed therethrough for axial alignment with and secured mounting to said generally rectangular waveguide and wherein said rectangular waveguide is secured to said waveguide mounting region of said at least one flange adaptor with solder.

27. The system as set forth in claim 26, wherein said waveguide is generally rectangular in cross sectional configuration.

28. The system as set forth in claim 26, wherein said one of a plurality of waveguide flanges comprises a waveguide flange that is generally round in shape, having a generally rectangular passageway disposed therethrough adapted for axial alignment with and mating engagement of said generally rectangular waveguide.

29. The system as set forth in claim 26, wherein said outer surface of said at least one flange adaptor includes a generally rectangular mating flange disposed peripherally therearound with a generally rectangular passageway disposed therethrough and adapted for axial alignment with, and mating engagement, of said rectangular waveguide.

30. The system as set forth in claim 26, wherein said inner surface of said at least one flange adaptor comprises a generally rectangular sleeve adapted for receiving said one of a plurality of waveguide flanges therein, said sleeve having a shoulder disposed thereacross for the abutting engagement of an end of said waveguide thereagainst.

31. The system as set forth in claim 26, wherein said one of a plurality of waveguide flanges comprises a generally rectangular waveguide flange adapted for mounting to said generally rectangular waveguide and said at least one flange adaptor includes a generally rectangular passageway disposed therethrough and adapted for axial alignment with, and mating engagement of, said generally rectangular waveguide.

32. The system as set forth in claim 26, wherein at least one of a plurality of waveguide flanges is constructed with a plurality of apertures disposed therein adapted for the receipt of threaded flange fasteners therethrough for the coupling of said one of a plurality of waveguide flanges to a mating surface such that the waveguide is coupled thereto.

33. The system as set forth in claim 26, wherein said outer surface of said at least one flange adaptor includes a groove adapted for the receipt of a gasket therein for providing sealing engagement with at least one of a plurality of waveguide flanges secured thereto.

34. The system as set forth in claim 26, wherein said at least one flange adaptor includes at least one aperture therethrough wherein said at least one fastener comprises a threaded plate fastener extending through said at least one aperture into at least one of a plurality of waveguide flanges.

35. A flange adaptor assembly for coupling one of a plurality of waveguide flanges to a waveguide, wherein said waveguide flanges have a generally common internal mating configuration, said flange adaptor assembly comprising:

a flange adaptor having inner and outer surfaces and wherein said outer surface is adapted to engage said generally common internal mating configuration of each one of said waveguide flanges and said inner surface is adapted for secured mounting to said waveguide; and a clamp for securing said at least one of a plurality of waveguide flanges to said outer surface of said flange adaptor such that said waveguide and said flange adaptor mounted thereto may be coupled to said select ones of said waveguide flanges for use therewith;

wherein said inner surface of said at least one flange adaptor comprises a waveguide mounting region adapted for receiving an end of said waveguide therein for the secured mounting thereto;

wherein said waveguide is generally rectangular in cross sectional configuration and wherein said flange adaptor is constructed with a generally rectangular passageway disposed therethrough for axial alignment with and secured mounting to said generally rectangular waveguide; and wherein said rectangular waveguide is secured in said waveguide mounting region of said flange adaptor with solder.

36. The assembly as set forth in claim 35, wherein said outer surface of said at least one flange adaptor includes a groove adapted for the receipt of a gasket therein for providing sealing engagement with said at least one of a plurality of waveguide flanges secured thereto.

37. The assembly as set forth in claim 35, wherein said at least one flange adaptor includes at least one aperture therethrough wherein said at least one fastener comprises a threaded plate fastener extending through said at least one aperture into said at least one of a plurality of waveguide flanges.

38. The assembly as set forth in claim 35, wherein said clamp includes at least one clamping member for engaging said flange adaptor and at least one fastener for securing said at least one flange adaptor between said at least one clamping member and said select ones of said waveguide flanges.

39. The assembly as set forth in claim 35, wherein said at least one of a plurality of waveguide flanges comprises a generally rectangular waveguide flange adapted for mounting to said generally rectangular waveguide and said at least one flange adaptor includes a generally rectangular passageway disposed therethrough and adapted for axial alignment with and mating engagement of said generally rectangular waveguide.

40. The assembly as set forth in claim 35, wherein said waveguide is generally rectangular in cross sectional configuration.

41. The assembly as set forth in claim 40, wherein said at least one of a plurality of waveguide flanges comprises a waveguide flange that is generally round in shape, having a generally rectangular passageway disposed therethrough adapted for axial alignment with and mating engagement of said generally rectangular waveguide.

42. The assembly as set forth in claim 40, wherein said outer surface of said at least one flange adaptor includes a generally rectangular mating flange disposed peripherally therearound with a generally rectangular passageway disposed therethrough and adapted for axial alignment with and mating engagement of said rectangular waveguide.

43. The assembly as set forth in claim 40, wherein said inner surface of said at least one flange adaptor comprises a generally rectangular sleeve adapted for receiving said one of a plurality of waveguide flanges therein, said sleeve having a shoulder disposed thereacross for the abutting engagement of an end of said waveguide thereagainst.

44. The assembly as set forth in claim 40, wherein said at least one of a plurality of waveguide flanges is constructed with a plurality of apertures disposed therein adapted for the receipt of threaded flange fasteners therethrough for the coupling of said one of a plurality of waveguide flanges to a mating surface such that the waveguide is coupled thereto.

45. The assembly as set forth in claim 44, wherein said at least one flange adaptor includes at least one aperture therethrough wherein said at least one fastener comprises a threaded plate fastener extending through said at least one aperture into said one of a plurality of waveguide flanges.

* * * * *